US008403065B2

(12) United States Patent
Taylor et al.

(10) Patent No.: US 8,403,065 B2
(45) Date of Patent: Mar. 26, 2013

(54) FLUID CONNECTION TO DRILLING RISER

(75) Inventors: Robert H. Taylor, Crosby, TX (US); Arthur Jones, Houston, TX (US)

(73) Assignee: Detail Designs, Inc., Houston, TX (US)

( * ) Notice: Subject to any disclaimer, the term of this patent is extended or adjusted under 35 U.S.C. 154(b) by 648 days.

(21) Appl. No.: 12/554,693

(22) Filed: Sep. 4, 2009

(65) Prior Publication Data

US 2011/0056701 A1 Mar. 10, 2011

(51) Int. Cl.

| | |
|---|---|
| ***E21B 23/00*** | (2006.01) |
| ***E21B 17/01*** | (2006.01) |
| ***E21B 15/02*** | (2006.01) |

(52) U.S. Cl. ..... 166/378; 166/367; 166/356

(58) Field of Classification Search ..... 166/338, 166/339, 341, 342, 344, 345, 350, 358, 359, 166/367.378–381

See application file for complete search history.

(56) References Cited

U.S. PATENT DOCUMENTS

| | | | | |
|---|---|---|---|---|
| 3,534,984 | A * | 10/1970 | Shuey | 285/24 |
| 3,678,996 | A | 7/1972 | Herd | |
| 4,142,584 | A * | 3/1979 | Brewer et al. | 166/359 |
| 4,367,055 | A | 1/1983 | Gentry | |
| 4,388,022 | A | 6/1983 | Gentry | |
| 4,400,109 | A | 8/1983 | Gentry | |
| 4,423,984 | A | 1/1984 | Panicker | |
| 4,643,614 | A | 2/1987 | Laursen | |
| 4,660,496 | A | 4/1987 | Helmersson | |
| 4,878,694 | A | 11/1989 | Castel | |
| 5,273,376 | A | 12/1993 | Ritter | |
| 6,042,303 | A * | 3/2000 | Head | 405/195.1 |
| 6,772,840 | B2 | 8/2004 | Headworth | |
| 7,040,393 | B2 * | 5/2006 | Adams et al. | 166/77.51 |

* cited by examiner

*Primary Examiner* — Thomas Beach
*Assistant Examiner* — James Sayre
(74) *Attorney, Agent, or Firm* — Bracewell & Giuliani LLP

(57) ABSTRACT

A riser for use in boring a subsea wellbore having a gooseneck assembly connected onto the riser. The gooseneck assembly has an outlet that couples with a flowline on the riser and a connector assembly that selectively decouples the gooseneck assembly from the flowline. A release member, such as a wire, cable, or rod, is attached to the connector so the connector assembly can be actuated by manipulating the release member from a remote location.

11 Claims, 7 Drawing Sheets

FLUID CONNECTION TO DRILLING RISER

FIELD OF THE INVENTION

The present disclosure generally relates to production of wells, and in particular to a connections coupling fluid lines to a drilling riser.

DESCRIPTION OF RELATED ART

Forming subsea wells from floating drilling support vessels typically involves providing a riser between the vessel and wellhead on the seafloor and inserting a drill string with attached drill bit through the riser. Fluids used during drilling are generally delivered to the wellhead through a circuit of flexible and rigid lines, where the flexible lines drop from the platform and connect to rigid lines attached to the riser. The connection between the flexible and rigid lines is often a "U" shaped gooseneck connection bolted to the riser.

Referring now to FIG. 1, shown in a side view is an example of a prior art subsea drilling assembly. The assembly 10 includes a floating rig 12 on the sea surface with an attached riser 16 spanning to a wellhead 18 anchored on the sea floor 20. A drill string 14 is shown inserted within the riser 16 and projecting through the wellhead assembly 18. A drill bit (not shown) on the drill string 14 terminal end bores a wellbore 22 through a formation 24 under the sea floor 20. The riser 16 includes a section 26 having a telescopic joint to account for bobbing motion of the floating rig 12.

Flexible fluid flow lines 28 drop from the floating rig 12 and connect with rigid flow lines 29 shown attached along the section 26 outer periphery. Gooseneck connectors 30 provide connection between the flexible flow lines 28 and the rigid flow lines 29. The fluid through the lines may include drilling fluid as well as fluid used during "choke and kill" operations, hydraulic fluid, or booster fluid. Typical drilling operations involve manually removing the gooseneck connections 30 from the riser section 26 when the riser section 26 is raised through the drill floor for well drilling operations. Due to the size and weight of the connections 30 and the location of the riser 16, manually removing the gooseneck connections 30 can pose a risk to personnel and equipment.

SUMMARY OF INVENTION

Disclosed herein is a riser for use in boring a wellbore subsea. The riser includes an annular body, a housing circumscribing at least a portion of the body, an elongated pocket formed in the housing and oriented with its length substantially parallel with the body, a flowline having an end projecting into an end of the pocket, a gooseneck assembly selectively inserted into the pocket, a connector assembly affixed on an end of the gooseneck assembly having a locked configuration coupled with the end of the flowline in the pocket and selectively and remotely movable into a released configuration that is free from the end of the flowline, so that the gooseneck assembly can be removed from the end of the flowline. Ears can be included on the gooseneck assembly that laterally protrude from opposite sides of the gooseneck assembly and profiles provided in the housing adjacent the pocket having a shape corresponding to the ears, so that the ears can pass into or out of the housing when aligned with the profiles.

Also disclosed is a gooseneck assembly for use with a subsea drilling riser. The gooseneck assembly can include, first and second ports for fluid flow, each port adapted for connection to a hose, a fluid flow exit adapted to receive therein an end of a drilling riser flow line, a remotely actuatable connector assembly latch provided on the end containing the second port, the latch adapted to receive an upper end of a flow line of the riser, and which snaps into engagement with the upper end of the flow line, and a pull line attached to the release mechanism for releasing the latch in response to a pull on the pull line.

Further disclosed is a method of operating a subsea excavation system, where the system includes a floating drilling platform, a riser depending from the platform to a subsea wellbore, and a flowline on the riser. The method includes deploying onto the riser a gooseneck assembly having a remotely actuated connection assembly, attaching the connection assembly the flowline on the riser so that the gooseneck assembly and flowline are in fluid communication, and releasing the gooseneck assembly from the flowline by remotely applying tension to a release line connected to a latch on the connection assembly.

DETAILED DESCRIPTION OF THE INVENTION

Figure 1:
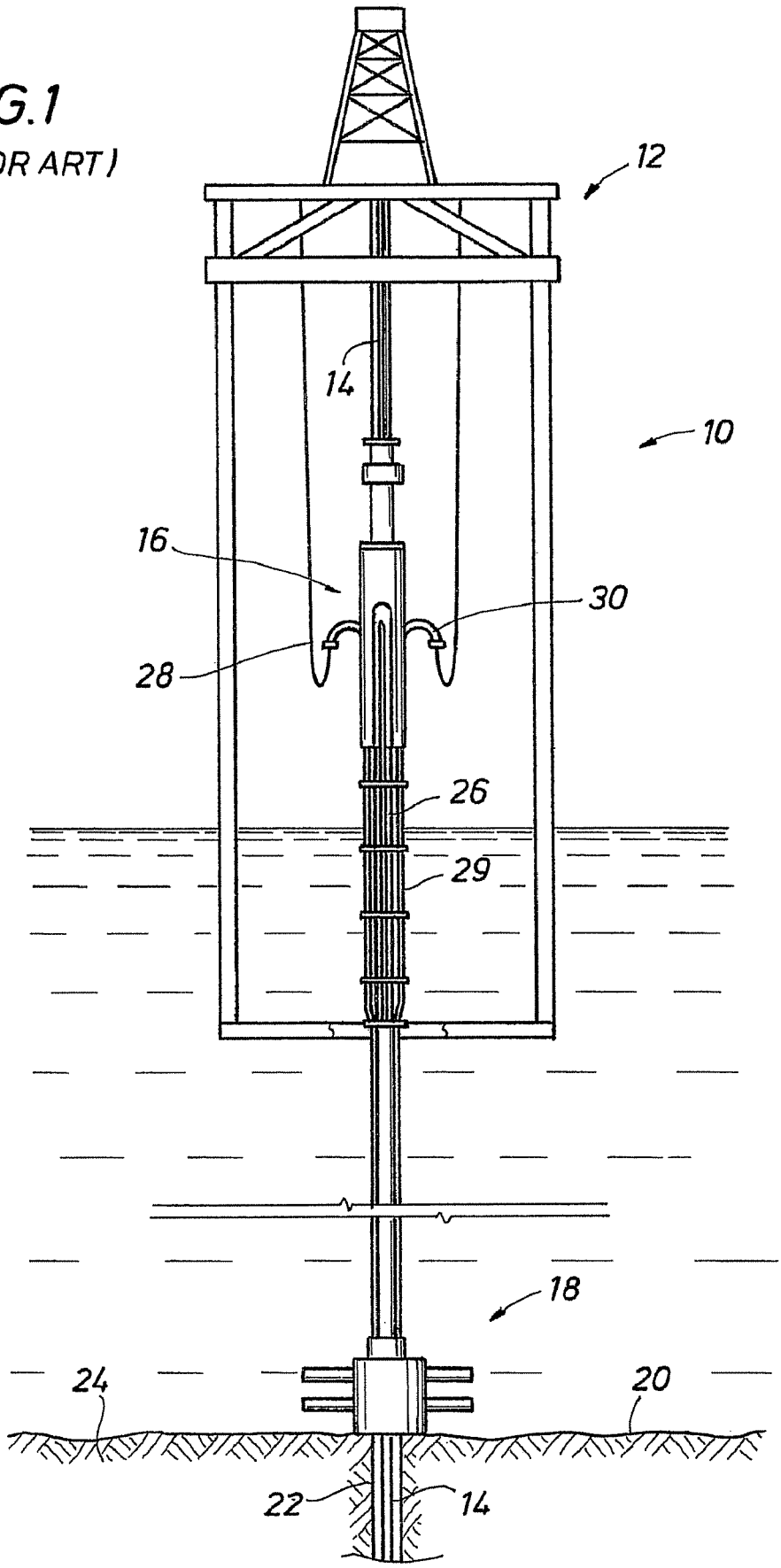
FIG.1 (PRIOR ART)
FIG. 1 is a side view of a prior art system for drilling subsea.

The device, system, and method of the present disclosure will now be described more fully hereinafter with reference to the accompanying drawings in which disclosed embodiments are shown. The disclosed subject matter may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

It is to be understood that the device, system, and/or method described herein is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the subject of applicant's disclosure is therefore to be limited only by the scope of the appended claims.

Figure 2:
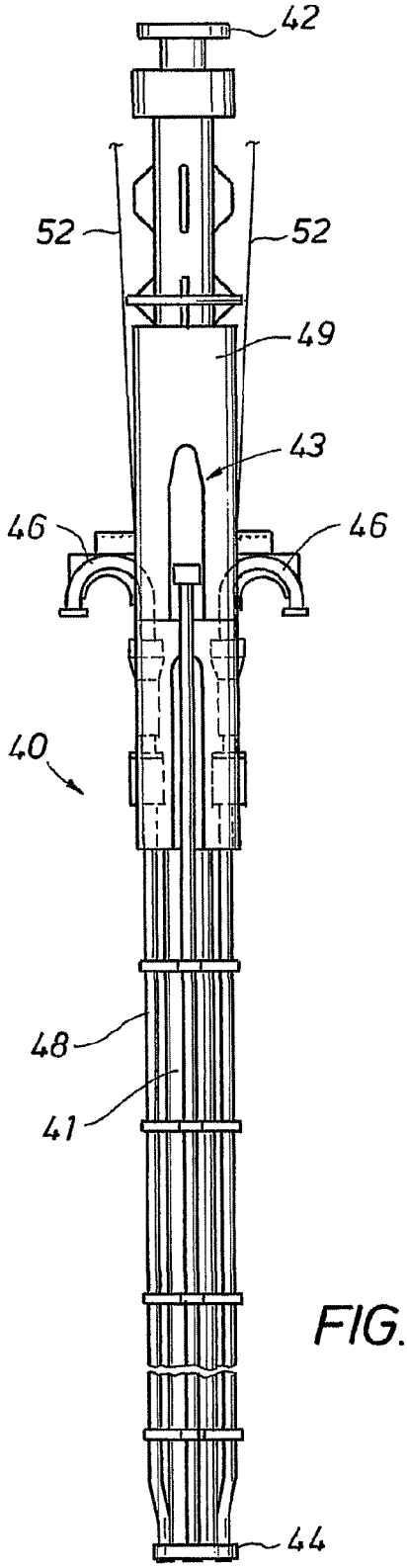
FIG. 2 provides a perspective view of a riser having gooseneck type fluid connections.

Shown in a side perspective view in FIG. 2 is an example of a riser section 40 in accordance with the present disclosure. The section 40 includes an annular riser body 41 through which a drill string or fluid may axially pass therethrough. A flange on the upper end provides an upper connection 42 for coupling the riser section 40 with a section of a riser suspended from a floating platform. Similarly, a flanged fitting on the lower end defines a lower connection 44 for connecting to a riser affixed to a wellhead. An outer barrel or cylindrical housing 49 covers a portion of the section 40; in the housing 49 are elongated pockets 43 aligned with the body 41. Gooseneck connections 46 are illustrated attached to the riser section 40 and disposed within the pockets 43. When anchored within the pockets 43, the gooseneck connector has a lower end coupled with an auxiliary flow line 48 attached along the riser section outer surface and along the body 41. Further described below is an elongated release member 52 shown connected to each gooseneck assembly 46.

Figure 3:
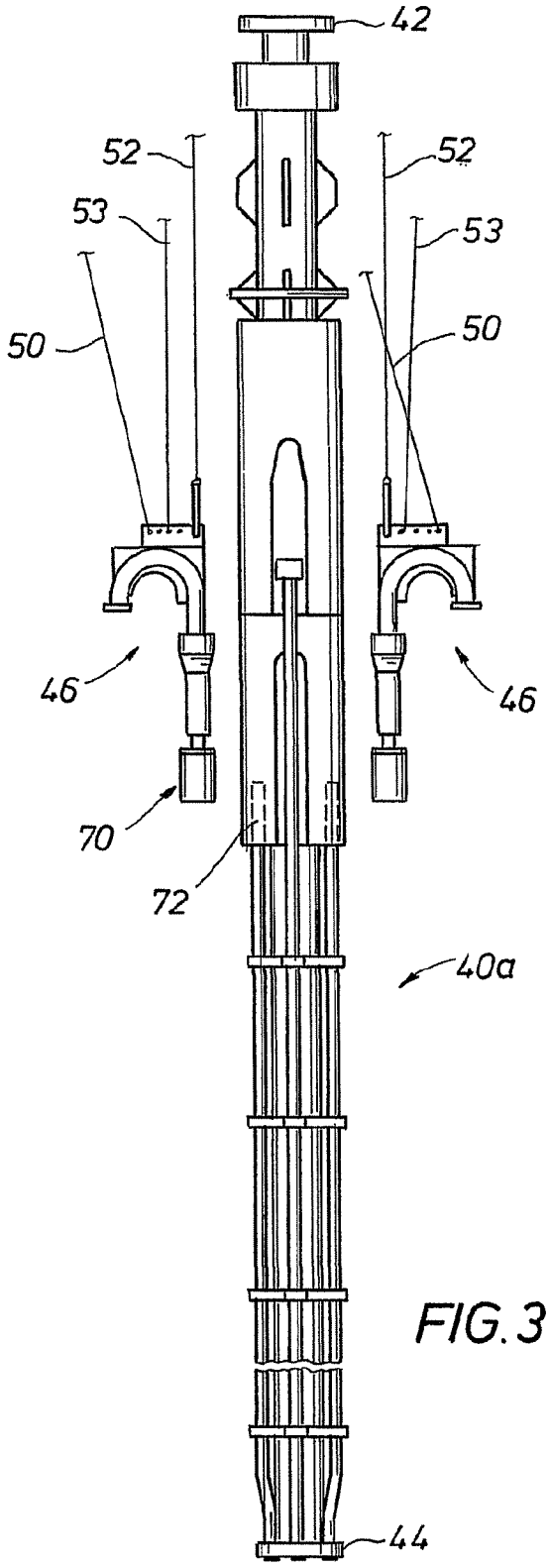
FIG. 3 depicts the riser of FIG. 2 with its fluid connections removed.

Referring now to FIG. 3, the gooseneck assemblies 46 are shown detached from the section 40 and outside of the pockets 43 supported by optional guy wires 50. As will be described in more detail below, in an embodiment, the gooseneck assemblies 46 are each shown coupled on their respective lower ends with a male sub 72. The male sub 72 is provided on the upper terminal end of an auxiliary line 48. The gooseneck assemblies 46 connection assembly 70 that may be selectively releasable from the male sub 72 and line 48 for decoupling and removal from the riser section 40. A release member 52 can be included to remotely and mechanically actuate the connection assembly 70 72 so manual gooseneck 46 removal is not required. An example of a release member 52, as shown in FIGS. 2 and 3, is an activation line that connects to the gooseneck assembly 46, for remotely actuating the connection assembly 70 enabling its release function. A handoff line 53, which may be included with each gooseneck assembly 46, can be used for raising and lowering the gooseneck assemblies 46.

Figure 4:
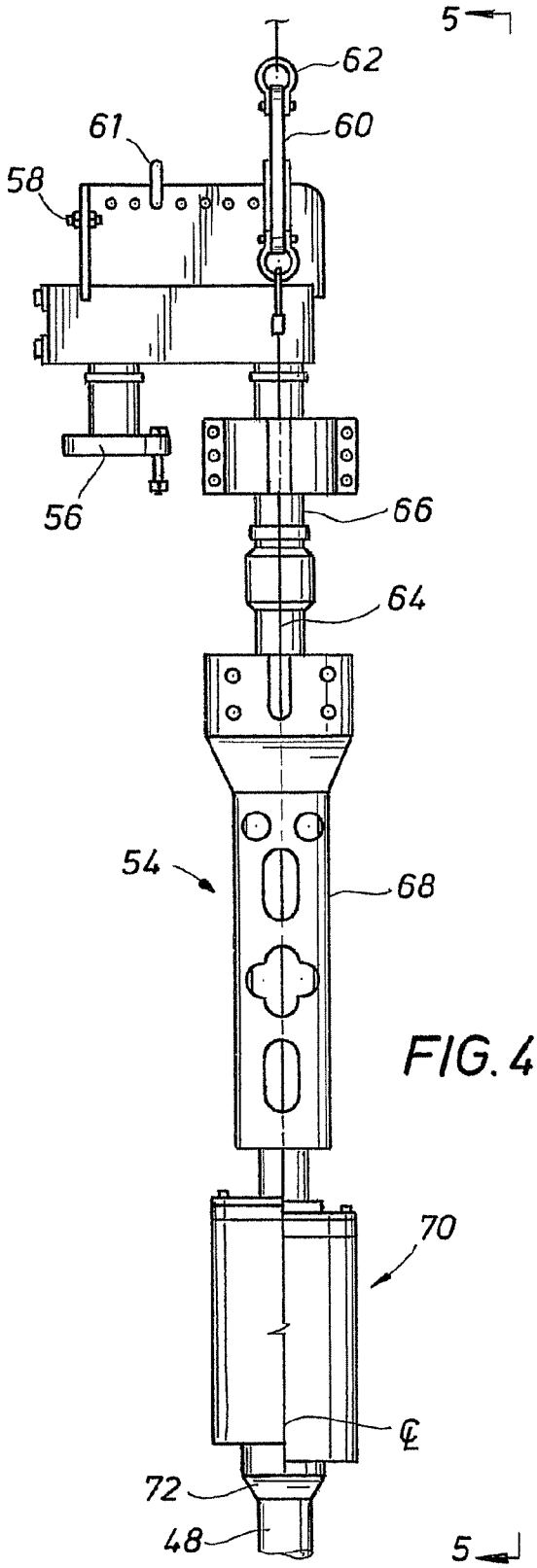
FIGS. 4 and 5 illustrate an example of gooseneck type fluid connections in side and rear views.

Referring now to FIG. 4, a side view of an example of an alternative gooseneck assembly 54 is shown. In this embodiment, the gooseneck has a U-shaped configuration starting with a fluid inlet 56 that extends through piping upward and courses laterally. The piping intersects with an elongated conduit 66 that foams a body section for the remaining portion of the gooseneck assembly 54. The fluid inlet 56 is flanged with bolt holes arranged around the flange providing for a bolted connection to connect to a flexible fluid flow line (not shown). A vertically disposed plate on the lateral portion of the inlet piping includes connections 58, 61 that are depicted as shackles. Connection 58 may include an attached guy wires 50 and connection 61 can be connected to the handoff line 53. Also on the vertical plate is an attached bridle 60 having a connection 62 on its upper end for connecting to the main activation line 52 and a connection on its lower end having an attached lead line 64. The lead line 64 is shown extending substantially parallel with the conduit 66 and terminating at the gooseneck connection assembly 70. A housing 68 circumscribes a portion of the conduit 66 above the connection assembly 70.

In the embodiment of FIG. 4, the connection assembly 70 is illustrated having an outer cylindrical configuration and shown protruding from its lower end is connector sub 72 for this embodiment, that as will be described below couples to the upper end of a riser flow line 48. A center line $C_L$ axially bisects the connection assembly 70. To the right of the center line $C_L$ represents the connection assembly 70 when in an engaged configuration and in connection with the flow line 48 (FIG. 2). On the left of the center line $C_L$ the connection assembly 70 is in a disengaged configuration (FIG. 3). As seen in FIG. 4, the connection assembly 70 when disengaged is at a higher elevation and thus circumscribing less of the male sub 72 than when engaged.

Figure 5:
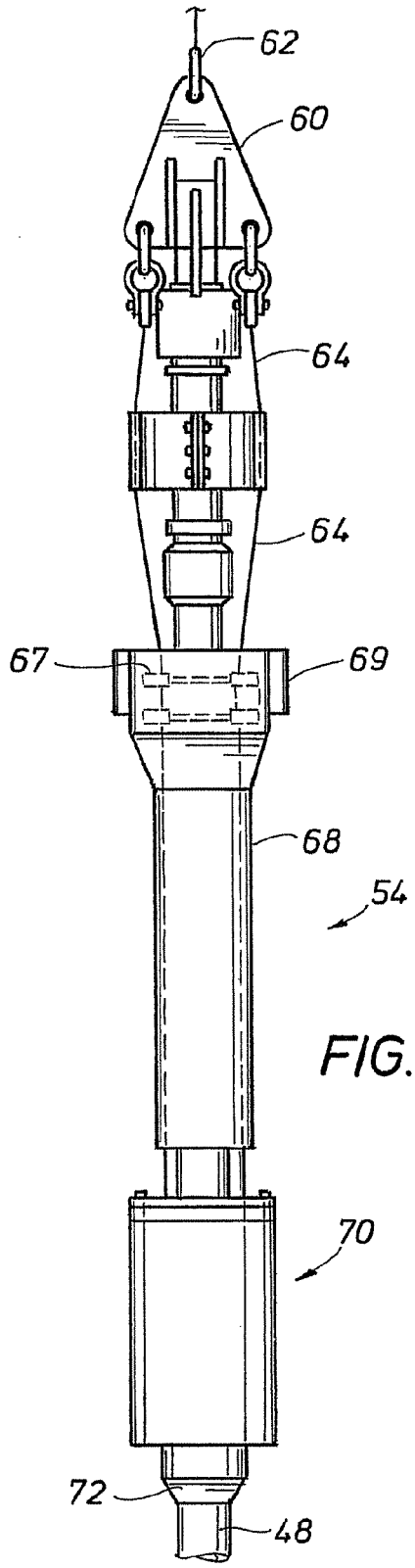

FIG. 5 provides a rearward view the gooseneck assembly 54 of FIG. 4. Shown in this view, the bridle 60 shape is generally triangular having a pair of lead lines 64 depending downward from opposing sides of the bridle 60 base. The connector 62 is shown on the apex of the bridle 60. Represented by a dashed outline are cable guides 67 anchored on the inner surface of the housing 68 proximate to where the conduit 66 enters the housing 68. The cable guides 67 are generally elongated members oriented perpendicular to the center line $C_L$. Shown adjacent the cable guides 67, and on the housing 68 outer surface are ears 69 projecting radially outward from the housing 68. As will be described later, the ears 68 in combination with profiles 45 on the riser housing 49 help retain the gooseneck assembly 54 within the riser 40.

Figure 6:
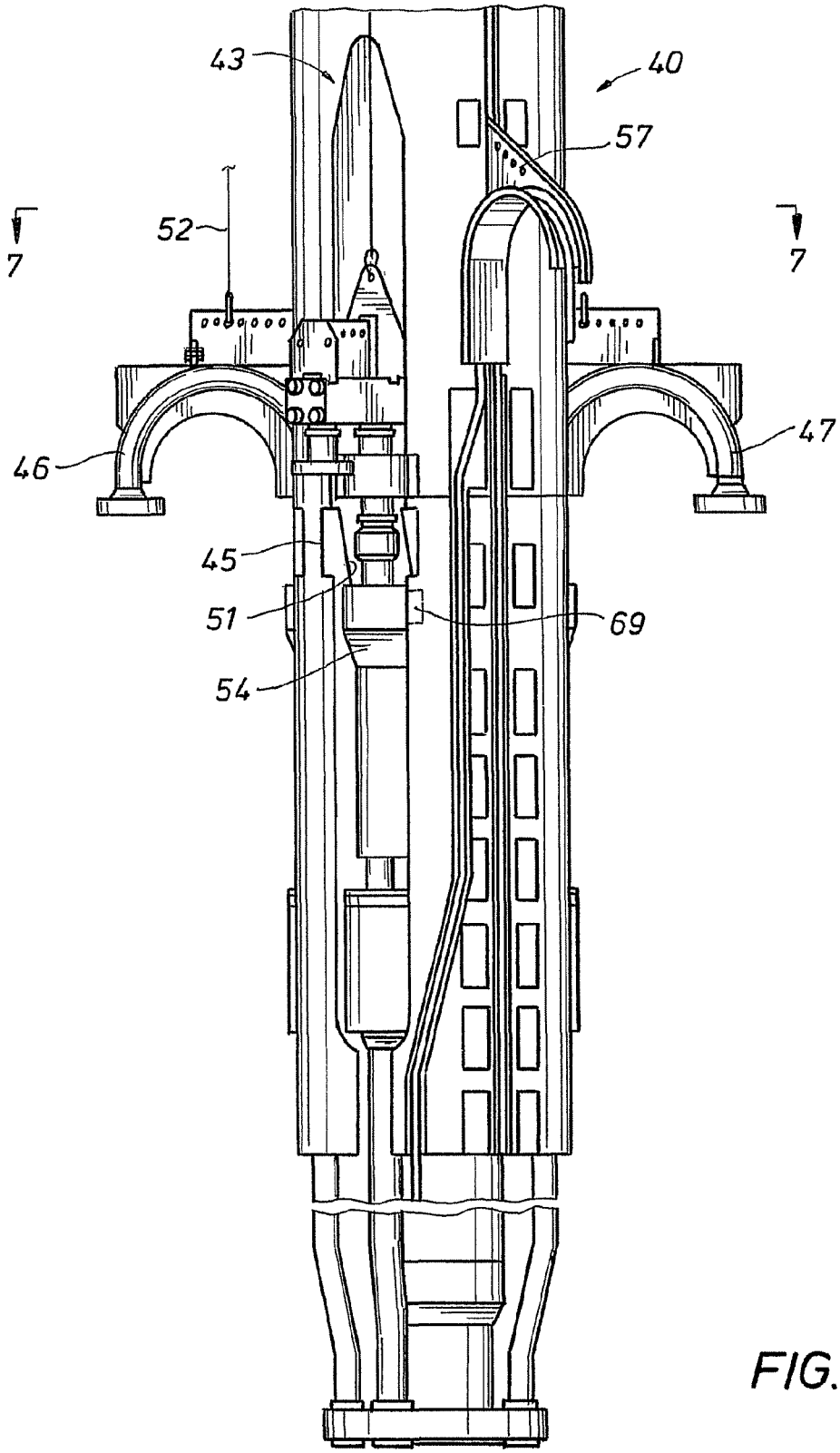
FIG. 6 depicts the riser of FIG. 2 in an enlarged side view.

A side view of an embodiment of a riser section 40 is illustrated in FIG. 6. Illustrated within pockets 43 formed on the riser housing 49 are various gooseneck assemblies 46, 47, 54. The pocket 43 having gooseneck 54 is shown with a profile 45 on its periphery. The profile 45 is a rectangular-shaped contour matching the shape and position of the ears 69. Accordingly, when vertically aligning the ears 69 of the gooseneck assembly 54 with the profiles 45 allows gooseneck assembly 54 insertion into the pocket 43. Once in the pocket 43 and having the ears 69 out of alignment with the profiles 45, the gooseneck assembly 54 is retained within the pocket 43 by the ears 69. A profile ramp 51 is illustrated within the pocket 43 and adjacent the profile 45. The ramp 51 is a plate-like member connecting on one end to the housing 49 inner surface adjacent the profile 45 upper end. The profile ramp 51 angles backward toward the inner portion of the pocket 43 so that when withdrawing the gooseneck 54 from within the window 43, the ears 69 can slide along the ramp 51 and be guided outward from within the pocket through the profile 45.

Figure 7:
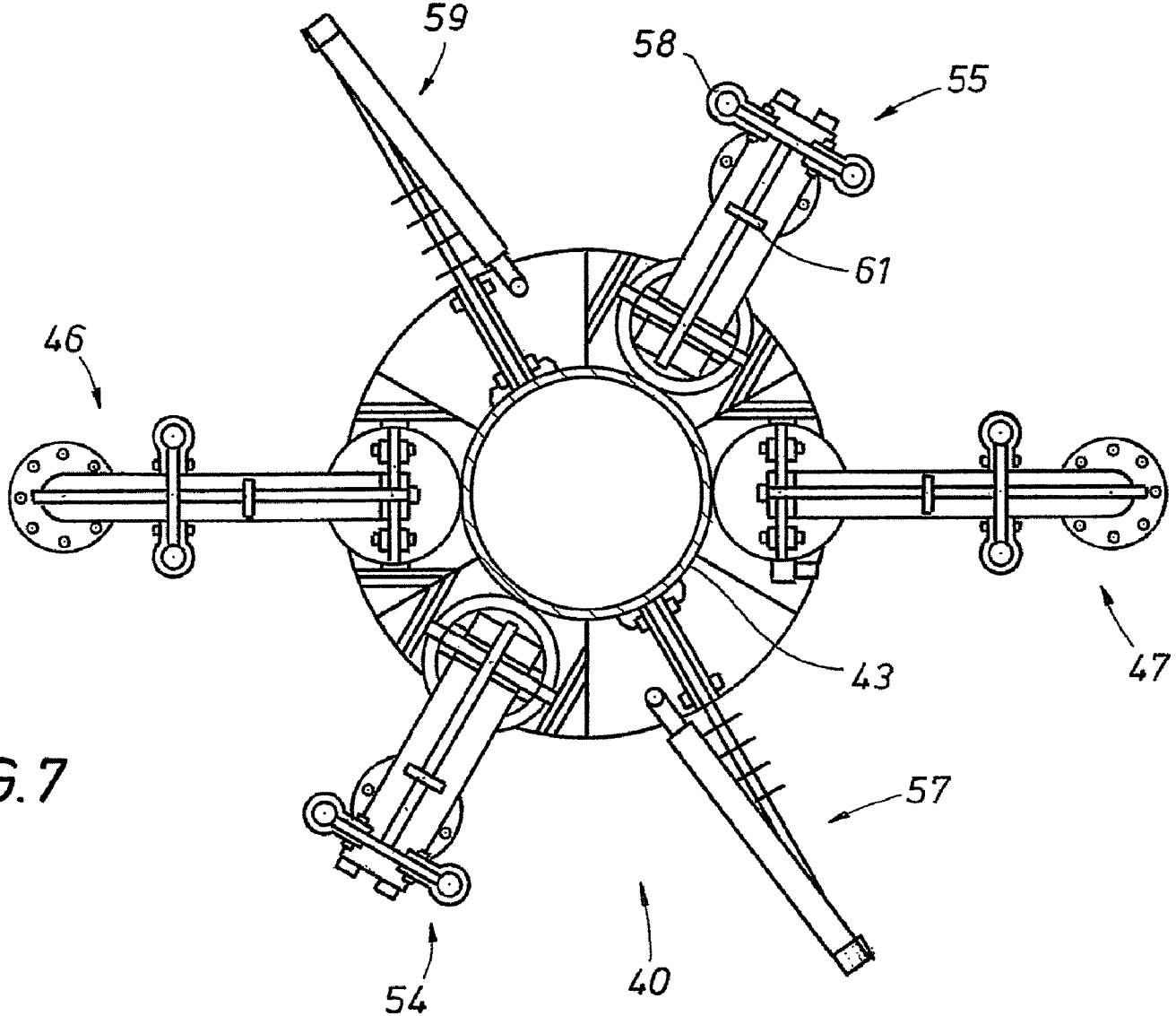
FIG. 7 is a sectional view of the riser of FIG. 6 taken along line 7-7.

FIG. 7 illustrates a sectional downward-looking view of the riser section 40 of FIG. 6 and taken along line 7-7. In this embodiment, the circular cross-section of the pockets 43 can be seen with the annular bodies of gooseneck assemblies 46, 47, 54, 55 therein. In this example, gooseneck 46 can be used for conveying or connecting hydraulic fluid to a rigid line on the riser 40, gooseneck assembly 47 can be used for providing booster fluid, and gooseneck assemblies 54, 55 used for delivering choke and kill fluids within the riser assembly 40. Accordingly, the system and method described herein is applicable with any type of gooseneck connection contemplated for use with oil and gas exploration and/or production. Additionally, illustrated in FIG. 7 are weldments 57, 59 for gooseneck mux lines.

Figure 8:
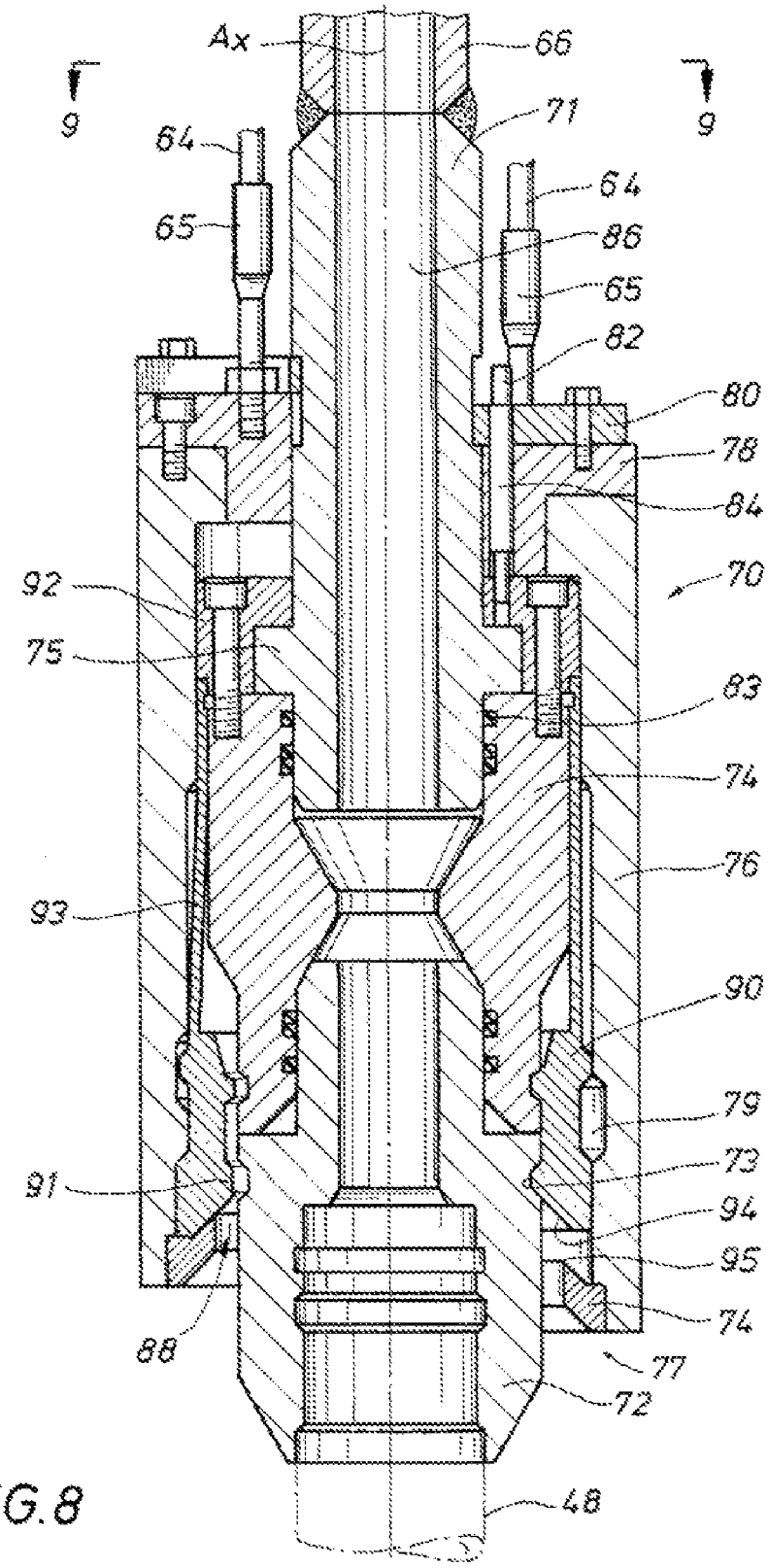
FIG. 8 portrays in side sectional view an example of a coupling assembly between the gooseneck and a line on the riser.

Shown in FIG. 8 is an example of a connection assembly 70 shown in a side sectional view; which can be employed for any of the gooseneck assemblies described and/or discussed herein. The connection assembly includes annular conduit extension 71 shown welded to the lower terminal end of the conduit 66. The conduit extension 71 and conduit 66 are coaxially formed around an axis $A_X$. A flange 75 radially circumscribes the conduit extension 71 on its end opposite where it attaches to the conduit 66. Similar to FIG. 4, FIG. 8 illustrates an engaged and disengaged configuration on opposing sides of the axis $A_X$. More specifically, the connection assembly 70 above the axis $A_X$ depicts it engaged with the connector sub 72 and below the axis $A_X$ the connection assembly 70 is depicted in a disengaged configuration. It should also be pointed out, the sections displayed above and below the axis $A_X$ do not lie in the same plane, as indicated along section line 8-8 in FIG. 9. The connector sub 72 is shown having profiles on its inner circumference for connection with a flow line upper end (not shown). When the assembly 70 is disengaged from the connector sub 72, the gooseneck assemblies 46, 47, 54, 55 with disengaged assembly 70 can be removed from its corresponding riser flow line.

Circumscribing the conduit extension 71 on its upper end are a disk-like stop plate 80 and a sleeve flange 78. The stop plate 80 and sleeve flange 78 are shown bolted together. The sleeve flange 78 radius at its upper portion is substantially equal to the stop plate 80 radius, but transitions to a smaller radius at a distance away from the stop plate 80. When the connection assembly 70 is in the engaged configuration, the sleeve flange 78 lower end rests against the upper surface of an annular collet assembly 88. Circumscribing the connection assembly 70 on its lower portion is an annular sleeve 76 having an upper end profiled to engage the sleeve flange 78 along its radial transition.

Figure 10:
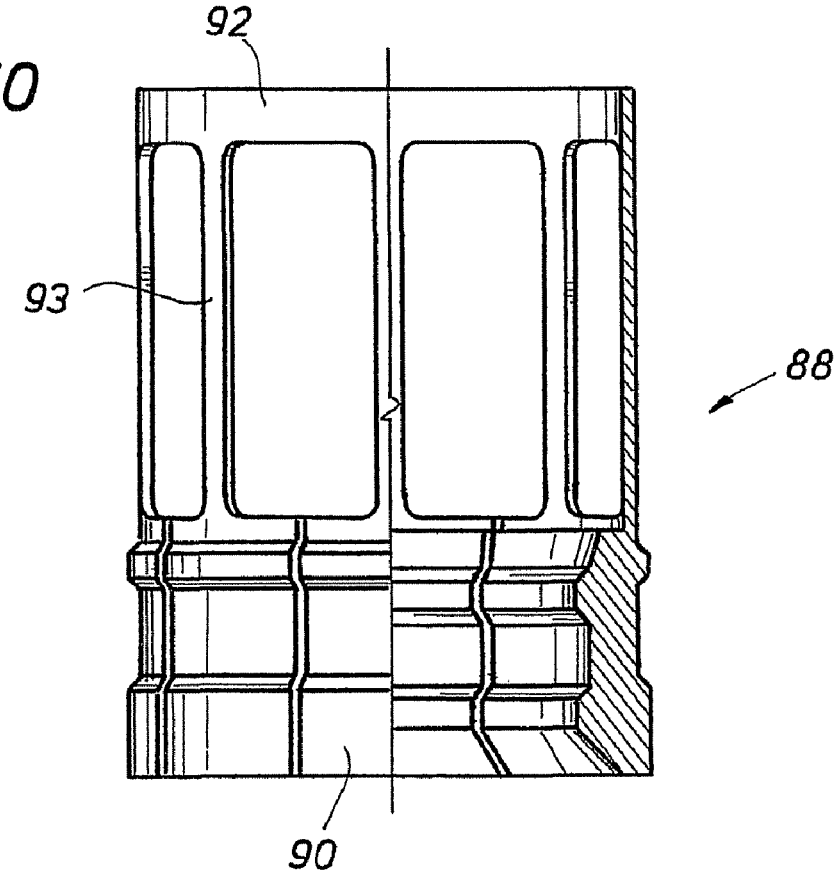
FIG. 10 provides a partial sectional view of the collet assembly of FIG. 8.

The collet assembly 88, as shown in a side partial sectional view in FIG. 10, includes on its upper end an annular base ring 92 and having a series of cantilevers/spring-element 93 depending from the base ring 92 and extending substantially parallel with the axis $A_X$ away from the base ring 92. The cantilevers/spring-element 93 circumscribe an annular receptacle connector 74 shown having an upper end that receives the conduit extension 71 therein and a lower end receiving the connector sub 72 upper end therein. Seals 83 are shown along the interface between the receptacle connector 74 and where it receives protruding male stabs of the conduit extension 71 and connector sub 72. Attached on the free end of the cantilevers/spring-element 93 are a series of segmented members 90 having a profiled surface facing the axis $A_X$ that form protrusions 91. When the connector assembly 70 is in the engaged configuration, the protrusions 91 fit within a groove 73 shown formed along the connector sub 72 outer surface. Each member 90 is shown having an angled surface 94 at its tip end at an angle from the protrusion 91 directed towards the sleeve 76 inner surface.

Shown threaded within the sleeve 76 lower end is an annular release ring 77. The release ring 77 has an upper end 95 directed towards the profiled segmented members 90. The upper end 95 has a surface at an angle corresponding to the angled surface 94 of the segmented members 90. Shown below the axis $A_X$ of FIG. 8, the sleeve 79 is slid toward the conduit 66 relative to its position above the axis $A_X$. This contacts the upper end 95 against the angled surface 94 to spread the member 90 radially outward toward the sleeve 76 out of its engagement with the groove 73. Removing the member 90 from the groove 73 releases the connector sub 72 from the connection assembly 70 enabling the gooseneck assembly 46, 47, 54, 55 to be freely withdrawn from its connection with the riser flow line. As noted above, pulling a release line remotely located pulls the activation bridle 60 and activation lead lines 64 to slide the sleeve 76 as described above to disengage the members 90 of the collet ring from the connector sub 72.

Figure 9:
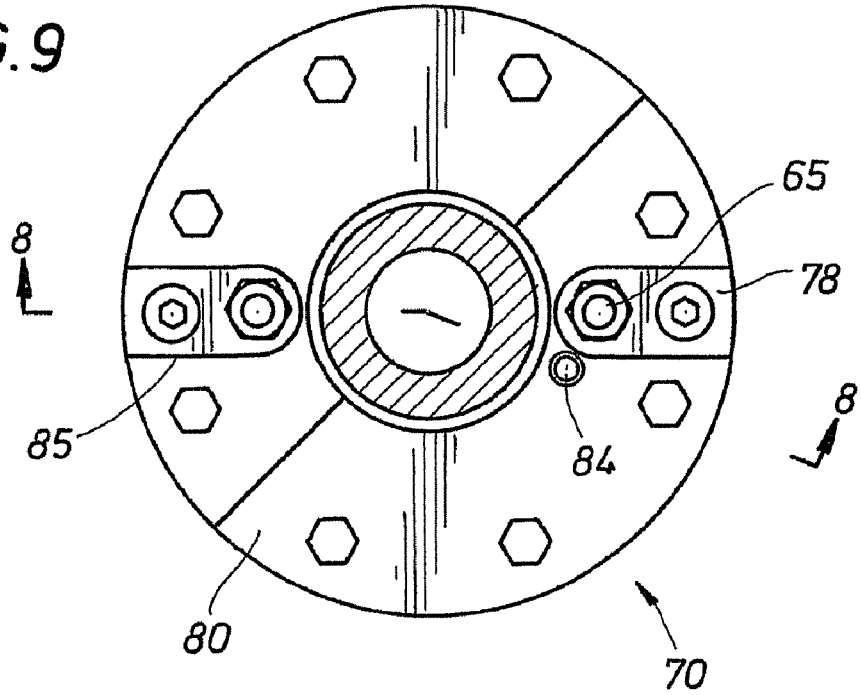
FIG. 9 is an overhead view of the assembly of FIG. 8.

Shown in FIG. 9 is a view taken along line 9-9 of FIG. 8. From this view, recesses 85 are shown formed in the stop plate 80 so that the lead line connector 65 bolts directly into the sleeve flange 78 below the stop plate 80. Also shown is a bore 84 in which an indicator pin 82 is inserted. Visibility of the indicator pin 82 may indicate whether or not the connector assembly 70 is in the engaged or disengaged configuration.

In one example of operation, a gooseneck assembly 46, 47, 54, 55 is suspended from an end of a handoff line 53, with the handoff line 53 other end being reeled from a platform, such as the platform 12 in FIG. 1. Guy wires 50 may also be attached to the gooseneck assembly 46, 47, 54, 55 to aid in guiding the assembly 46, 47, 54, 55 to a corresponding pocket 43 within the riser 40. Tension is maintained in the release member 52 so that the lead lines 64 draw the sleeve 76 upward so the release ring 77 radially outward spreads the segmented members 90 against the sleeve 76, as represented in FIG. 8 below the axis $A_X$. This maintains the connection assembly 70 in its disengaged position. After insertion within a pocket 43, including positioning the ears 69 and profile 45, the assembly 46, 47, 54, 55 is lowered within the pocket 43 by slowly releasing tension in the handoff line 53. The ears 69 are guided along the ramp 51 to orient the gooseneck assembly 46, 47, 54, 55 within the pocket 43 so the opening on the connection assembly 70 bottom end receives therein the male sub 72 upper end. The receptacle connector 74 lower terminal end seats on an annular shoulder 81 formed by a radial transition on the male sub 72. When tension on the release member 52 is released, the mass of the moving components in the connection assembly 70 moves the sleeve 76 from its configuration shown below the axis $A_X$ to the configuration provided above the axis $A_X$. This separates the release ring 77 from the members 90 allowing inward radial movement into engagement with the groove 73 on male sub 72 to couple the gooseneck assembly 46, 47, 54, 55 to the flow line 48. Removing the gooseneck assembly 46, 47, 54, 55 from within the pocket 43 involves tensioning the release member 52 to move the sleeve 76 to the below axis $A_X$ configuration. The gooseneck assembly 46, 47, 54, 55, now disengaged, can be pulled upward, either by the release member 52 or handoff line 53. In one example of use, the release member 52 travel is limited to the distance required to move the sleeve 76 from/to an engaged to/from a disengaged configuration, and thus not used for raising or lowering the gooseneck assembly 46, 47, 54, 55. In another embodiment, a single handoff line 52 is used for raising/lowering each gooseneck assembly 46, 47, 54, 55; this reduces the number of lines on the drilling assembly to minimize safety concerns.

The present system and method described herein, therefore, is well adapted to carry out and attain the ends and advantages mentioned, as well as others inherent therein. While a presently preferred embodiment has been given for purposes of disclosure, numerous changes exist in the details of procedures for accomplishing the desired results. For example, connection between the passages that extend between the upper and lower valve blocks 46, 47 may be accomplished with seal stabs. These and other similar modifications will readily suggest themselves to those skilled in the art, and are intended to be encompassed within the spirit of the present invention disclosed herein and the scope of the appended claims.

What is claimed is:

1. A mounting assembly for coupling a gooseneck assembly with a subsea drilling riser comprising:

fluid now first and second ports on the gooseneck assembly;

a fluid flow exit adapted to receive therein an end of a drilling riser flow line;

an annular collet spring comprising an annular base ring attached to the fluid flow exit and a segmented body forming cantilevers depending from the base ring and profiled members on the ends of the cantilevers opposite the base ring;

a remotely actuatable connector assembly latch provided on an end of the gooseneck assembly having the second port, the latch adapted to receive an upper end of a flow line of the riser, and which snaps into engagement with the upper end of the flow line; and a pull line attached to the release mechanism for releasing the latch in response to a pull on the pull line.

2. The mounting assembly of claim 1, wherein the cantilevers have an external recess and adjacent band on their outer sides apposite the profiled members; and wherein the latch further comprises a sleeve having an annular internal rib, the sleeve being axially moveable from a locked position with the rib engaging the band and the collet spring to a released position with the ribs engaging the recesses.

3. The mounting assembly of claim 2, further comprising a release ring on the inner diameter of the sleeve, the release ring engaging the profiled member of the cantilever and moving the cantilevers outward to the released position.

4. The mounting assembly or claim 1, wherein the latch comprises:

a cantilevered spring member adapted to circumscribe the end of the riser flowline and attached on a first end to the gooseneck assembly;

a profile on the spring member second end projecting radially inward to the flowline axis to define a protrusion, and angled outward away from the flowline axis defining a tapered end;

a sleeve circumscribing the spring member; and a release member on the sleeve having, an end angled parallel with the spring member tapered end, so that when moving the sleeve in a direction to engage the release member with the spring member tapered end, the release member disengages the spring member from the groove.

5. A coupling assembly liar connecting a gooseneck assembly to an end of a flowline on a drilling riser, the coupling assembly comprising:

a cantilevered spring member having;

a first end attached to the gooseneck assembly;

a second end circumscribing the flowline end; and a profile on the spring member second end with a portion projecting inward toward the flowline axis defining it protrusion, the profile then angled outward away from the flowline axis to form a tapered end;

an annular groove on the end of the flowline;

a sleeve circumscribing the spring member; and an annular release ring on the sleeve end having an end angled parallel with the spring member tapered end, so that moving the sleeve in a direction to engage the release member with the spring member tapered end, the release member disengages the spring member from the groove.

6. The coupling assembly of claim 5, further comprising a pull line attached on one end to the sleeve and having a second end at a location remote to the coupling assembly for moving the sleeve relative to the flowline end in response to tension.

7. The coupling assembly of claim 6, further comprising a disk like plate coaxially connected on an end of the sleeve, and an attachment anchoring the pull line to the plate.

8. The coupling assembly of claim 5, further comprising an annular body having:

an opening on its lower end adapted to receive the upper end of the flowline; and an opening on its upper end coupled with the hose.

9. A method of coupling a gooseneck assembly to a subsea riser comprising:

a. mounting a coupling assembly having a pocket around a portion of the riser;

b. providing a gooseneck assembly having a remotely actuated connection assembly and inserting an end of the gooseneck assembly into the pocket;

c. attaching the connection assembly to a flowline on the riser so that the gooseneck assembly and flowline are in fluid communication; and d. releasing the gooseneck assembly from the flowline by remotely applying tension to a release line connected to a latch on the connection assembly.

10. The method of claim 9, father comprising removing the gooseneck assembly from the riser.

11. The method of claim 9, wherein step (a) comprises orienting the gooseneck assembly so that ears on the gooseneck assembly register with profiles on the riser.

* * * * *

UNITED STATES PATENT AND TRADEMARK OFFICE

CERTIFICATE OF CORRECTION

PATENT NO. : 8,403,065 B2
APPLICATION NO. : 12/554693
DATED : March 26, 2013
INVENTOR(S) : Taylor et al.

It is certified that error appears in the above-identified patent and that said Letters Patent is hereby corrected as shown below:

In the Claims

Column 6, Claim 1, line 52 "fluid now first and second ports on the gooseneck" should read --fluid flow first and second ports on the gooseneck--

Column 7, Claim 2, line 3 "sides apposite the profiled members" should read --sides opposite the profiled members--

Column 7, Claim 4, line 13 "The mounting assembly or claim 1" should read --The mounting assembly of claim 1--

Column 7, Claim 5, line 29 "A coupling assembly liar connecting" should read --A coupling assembly for connecting--

Column 7, Claim 5, line 36 "the flowline axis defining it" should read --the flowline axis defining a--

Column 8, Claim 10, line 33 "father comprising removing the" should read --further comprising removing the--

Signed and Sealed this
Sixteenth Day of July, 2013

Teresa Stanek Rea

Teresa Stanek Rea
*Acting Director of the United States Patent and Trademark Office*